United States Patent [19]

Wenthe et al.

[11] 4,084,806

[45] Apr. 18, 1978

[54] SHEET HANDLING APPARATUS

[75] Inventors: Stephen James Wenthe, Rochester; David Arlen Caswell, Holley, both of N.Y.

[73] Assignee: Eastman Kodak Company, Rochester, N.Y.

[21] Appl. No.: 740,526

[22] Filed: Nov. 10, 1976

[51] Int. Cl.[2] ..... B65H 29/20

[52] U.S. Cl. ..... 271/80; 29/126; 29/127; 198/579; 271/194; 432/60

[58] Field of Search ..... 271/80, 174, DIG. 2, 271/194, 195, 196, 197; 29/126, 127, 121.4; 198/579, 623; 432/60; 118/60, 245

[56] References Cited

U.S. PATENT DOCUMENTS

| | | | |
|---|---|---|---|
| 623,285 | 4/1899 | Marshall | 29/126 |
| 3,578,859 | 5/1971 | Stillings | 271/80 X |
| 3,701,526 | 10/1972 | Hope et al. | 271/80 X |
| 3,791,731 | 2/1974 | Mihalik | 29/126 X |
| 3,800,432 | 4/1974 | Miyata et al. | 271/195 X |
| 3,913,521 | 10/1975 | Bar-on | 432/60 X |

*Primary Examiner*—Bruce H. Stoner, Jr.
*Attorney, Agent, or Firm*—Lawrence P. Kessler

[57] ABSTRACT

A receiver member guide mechanism for a receiver member bearing a toned image, the mechanism including an open-wound helical spring wrapped tightly in a second helix around a support shaft. The shaft is positioned to locate the spring beneath the receiver member travel path. The shaft is rotated at a high rate of speed so that if a receiver member drops below the normal travel path, the lead edge of the member will be struck by the convolutions of the spring and redirected back into the travel path. The orientation of the convolutions of the spring is selected such that the peripheral surface of the convolutions provide only point contact with a receiver member so as to prevent smearing of the toned image.

3 Claims, 3 Drawing Figures

SHEET HANDLING APPARATUS

BACKGROUND OF THE INVENTION

1. Field of the Invention

This invention relates to sheet handling apparatus, and more particularly to a guide for maintaining receiver sheets, bearing a toned image, in a travel path between a series of transport mechanisms.

2. Description of the Prior Art

In the copy/duplicating field, it is common to use electrostatic principles to form charged latent images on intermediate photoconductive members. The charged latent images are developed by application of oppositely charged toner particles to the image area. After development, the image is transferred to a receiver member, such as a sheet of paper, brought into intimate contact with the developed image. The transferred image is fixed to the receiver member by, for example, the application of heat and/or pressure which causes the toner to become tackified and stick to the receiver member.

Transport of the receiver member from the fixing station must be accomplished with care since the toner on the receiver member may remain in its tackified state for a finite period of time and can thus be smeared if not handled properly. If the toned image is on the underside of the receiver member, the member may be transported by a vacuum transport positioned above the receiver member travel path. However, since the beam strength of the receiver member may be adversely affected in the fixing operation, a guide for the receiver member between the fixing station and the transport is desireable. As noted, care must be taken in handling the member in this area because of the potential smear problem.

SUMMARY OF THE INVENTION

It is the purpose of this invention to provide a guide for maintaining a receiver member in its travel path between transport stations without smearing a toned image on the receiver member. The guide includes an open-wound helical spring wrapped tightly in a second helix around a support shaft. The shaft is positioned to locate the spring beneath the receiver member travel path. The shaft is rotated at a high rate of speed so that if a receiver member drops below the normal travel path the lead edge of the member will be struck by the convolutions of the spring and redirected back into the travel path. The orientation of the convolutions of the spring is selected such that the peripheral surface of the convolutions provide only point contact with any receiver member coming in contact therewith so as to avoid smearing of the toned image on the member.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
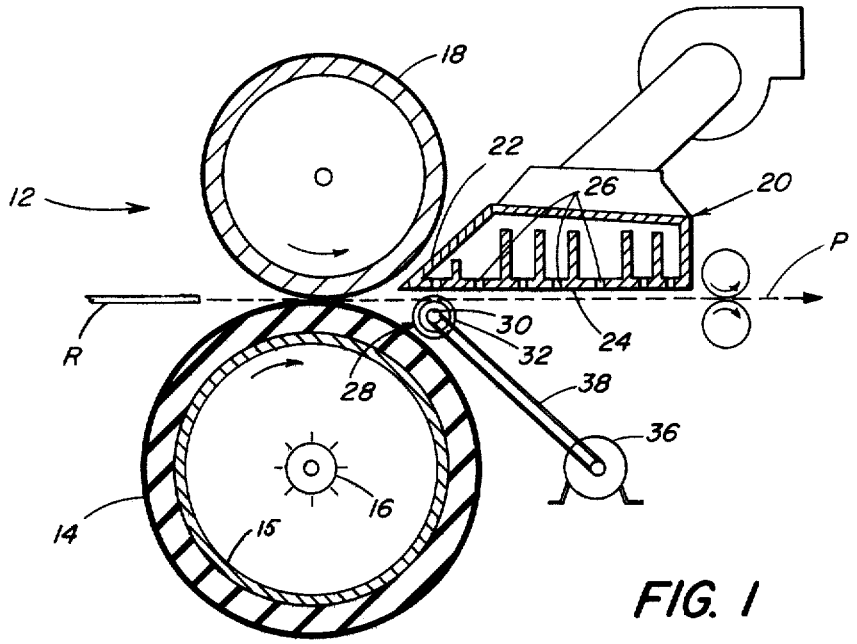
FIG. 1 is a side elevational view, partly in section of a receiver member transport path, incorporating the guide mechanism of this invention.

Referring now the drawings, FIG. 1 shows a segment of a transport path, such as a fixing station 12 of an electro-photographic copier. A full description of a similar fixing station may be found in Research Disclosure Bulletin, Vol. 137, at page 6 (published by Industrial Opportunities, Ltd., Homewell, Havant, Hampshire, PO9 1EF, U.K.); the particular fixing station 12 being herein described only to the extent necessary to provide a complete understanding of the instant invention. The fixing station 12 includes a rubber coated fusing roller 14, supported on a core 15, having an internal heating lamp 16. A pressure roller 18 mates with the fusing roller 14 to form a pressure nip therebetween. Receiver members R, such as sheets of paper, bearing toner images on the underside, travel seriatim along the path P through the nip. The heat and pressure in the nip tackifies the toner causing the toner to become fixed to the receiver member.

When a receiver member leaves the nip between the rollers 14 and 18, the fused toner thereon may be in a semisoft state so that contact with the image surface should be avoided. Therefore a transport such as the vacuum transport 20 is provided for moving the receiver member along the travel path P without contacting the image surface. The vacuum transport 20 has a forward end 22 located as close as possible to the nip of the rollers 14 and 18, and a base plate 24 located immediately above the travel path P. The base plate 24 has a series of ports 26 extending therethrough such that when a sub-atmospheric pressure is established within the transport 20, receiver members moving along the path P will be drawn to the base plate 24. The receiver member will thus be supported, as the member moves along the path, for a time sufficient to cool the receiver member and solidify the fused toner image on the member. After the image is cooled the member may then be handled by conventional transport means.

Figure 2:
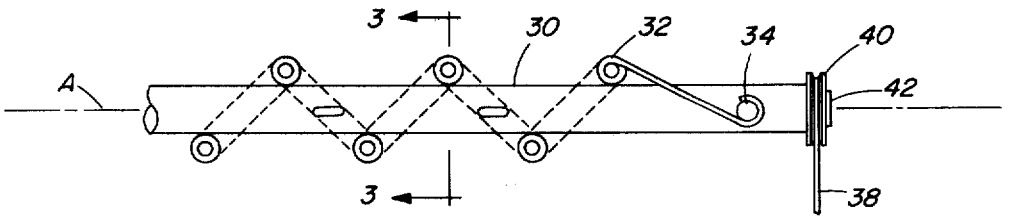
FIG. 2 is a front elevational view of the guide mechanism of this invention.
Figure 3:
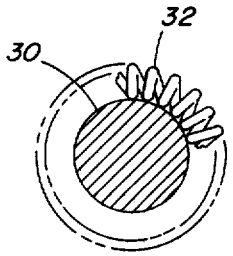
FIG. 3 is a cross-sectional view of the guide mechanism of FIG. 2 taken along lines 3—3.

The heat and pressure generated in the fixing station 12 can affect the receiver members, particularly if they are sheets of paper of lightweight bond, to reduce the beam strength thereof. When the beam strength is reduced, the receiver member may have a tendency to drop away from the travel path and, instead of coming under the influence of the vacuum from the transport 20, will jam in the fixing station. Therefore the guide 28 of this invention is provided. The guide 28 comprises a shaft 30 positioned beneath the forward end 22 of the transport 20 on the opposite side of the travel path P from the transport closely adjacent the exit of the nip of rollers 14 and 18. A spring 32 defining a first helix (see FIGS. 2 and 3) is fixed at its ends 34 to the shaft 30. The spring 32 is wrapped tightly about the shaft 30 in a second helix (i.e., successive convolutions of the helix being spaced apart) open wound. The second helix of the spring 32 is selected such that the outer segments of the convolutions forming the first helix are oriented parallel to the axis A of the shaft 30 in a plane including the axis A. The shaft 30 is driven in a clock-wise direction (as viewed in FIG. 1) at a high rate of speed by a motor 36 through a belt drive 38 cooperating with a pulley 40 fixed to the end 42 of the shaft 30.

In operation of the electrophotographic copier, receiver members R passing seriatim through the fixing station 12 will traverse the travel path P to the vacuum transport 20 and thence to downstream transport mechanisms. If the beam strength of a receiver member is adversely affected in the fixing station, the receiver member will drop beneath the travel path. Due to the location of the shaft 30 and its angular speed of rotation, any such member dropping beneath the path will come in contact with the rotating spring 32 of the guide 28. The convolutions of the spring 32 will act as a "flipper" striking the lead edge of the member for moving (redirecting) the member back into the path P where it will come under the influence of the vacuum from the transport 20. As noted above, geometry of the helix of the spring 32 and its second helix-wrap around shaft 30 orients the outer surfaces of the convolutions of the spring parallel to the rotational axis of the shaft 30. As a result of this orientation, the spring 32 will be effective to redirect receiver members striking the guide 28 even when those members strike the guide below the center line thereof. Furthermore, this orientation of convolutions ensures that contact between a receiver member and the peripheral surface of the convolutions of the spring 32 will be of a point contact so as to avoid smearing of the toned image.

From the foregoing it is apparent that there has herein been provided a guide for toner-bearing receiver members traveling between fuser rollers and a downstream vacuum transport in an electrophotographic fixing station. An open-wound helical spring wrapped in a second helix about a rotating shaft is positioned to strike any sheet dropping beneath the travel path between the fixing station and the adjacent downstream vacuum transport. The orientation of the helices of the spring insures that all sheets striking the spring will be redirected to the vacuum transport and that only point contact will occur between the peripheral surfaces of the convolutions of the spring and the image-bearing surface of the receiver member to avoid smearing of the toned image.

The invention has been described in detail with particular reference to the preferred embodiment thereof, but it will be understood that variations and modifications can be effected within the spirit and scope of the invention.

We claim:

1. In a sheet handling apparatus having means for transporting sheets at a given velocity along a sheet travel path, guide means for moving sheets diverging from said travel path back into said travel path, said guide means comprising:

shaft means located adjacent to said travel path, a helical spring defining a first helix and mounted in a second helix about said shaft means so as to engage any sheet diverging from said travel path, said second helix of said spring being open-wound such that the outer segments of the convolutions forming said first helix are parallel to the rotational axis of said shaft means and lie in a plane including said axis, and means for rotating said shaft means in a direction and at an angular speed such that the periphery of the convolutions forming said first helix at the point closest to said travel path move in the same direction as the transported sheets and at a tangential velocity greater than said given sheet velocity, whereby any sheet engaged by the spring is moved back into said travel path.

2. In an electrophotographic copier apparatus having a fixing station for fixing toner images to a receiver member by heat and/or pressure, and means for transporting image-bearing receiver members seriatim at a given velocity along a travel path through said fixing station and then away from said fixing station, guide means for moving any receiver member diverging from said travel path downstream of said fixing station back into said travel path, said guide means comprising: a shaft, a helical spring defining a first helix, having its ends fixed to said shaft and mounted in a second helix about said shaft, said second helix being open-wound such that the outer segments of the convolutions forming said first helix of said spring are parallel to the rotational axis of said shaft means and lie in a plane including said axis, said shaft being located downstream of said fixing station adjacent to said travel path to position said spring to engage the lead edge of any image-bearing receiver member exiting from said fixing station which moves away from said travel path, and means for rotating said shaft in a direction and at an angular speed such that the periphery of the convolutions of said first helix at the point closest to the travel path move in the same direction as the transported receiver members and at a tangential velocity greater than said given velocity, whereby any image-bearing receiver member engaged by said spring is moved back into said travel path.

3. The invention of claim 2 wherein said transport means includes a vacuum transport apparatus located above said travel path.

* * * * *